US005273635A

United States Patent [19]

Gernert et al.

[11] Patent Number: 5,273,635

[45] Date of Patent: Dec. 28, 1993

[54] ELECTROLYTIC HEATER

[75] Inventors: Nelson J. Gernert, Elizabethtown; Robert M. Shaubach, Litiz; Donald M. Ernst, Leola, all of Pa.

[73] Assignee: Thermacore, Inc., Lancaster, Pa.

[21] Appl. No.: 894,287

[22] Filed: Jun. 4, 1992

[51] Int. Cl.[5] ..... C25B 9/00; C25B 15/08

[52] U.S. Cl. ..... 204/241; 204/274; 204/275; 204/277; 204/278; 204/290 F; 204/292

[58] Field of Search ..... 204/241, 242, 274, 290 F, 204/292, 275-278

[56] References Cited

U.S. PATENT DOCUMENTS

| | | | |
|---|---|---|---|
| 498,771 | 6/1893 | Craney | 204/283 |
| 558,176 | 4/1896 | Huber | 204/DIG. 6 |
| 2,098,629 | 11/1937 | Knowlton | 204/DIG. 6 |
| 3,104,308 | 9/1963 | Wilson | 204/275 X |
| 3,131,135 | 4/1964 | Coopersmith | 204/274 X |
| 3,877,989 | 4/1975 | Waldman et al. | 204/DIG. 6 |
| 3,975,913 | 8/1976 | Erickson | 204/DIG. 6 |
| 4,206,018 | 6/1980 | Kreisel et al. | 204/241 X |
| 4,336,122 | 6/1982 | Spirig | 204/274 X |
| 4,420,381 | 12/1983 | Silvotti et al. | 204/274 X |
| 4,749,463 | 6/1988 | Holmen | 204/241 |
| 4,872,957 | 10/1989 | Dong et al. | 204/283 |
| 4,911,803 | 3/1990 | Kunz | 204/283 |
| 4,931,168 | 6/1990 | Watanabe et al. | 204/283 |
| 4,980,037 | 12/1990 | Hossain et al. | 204/283 |
| 5,089,107 | 2/1992 | Pacheco | 204/241 X |

*Primary Examiner*—Donald R. Valentine
*Attorney, Agent, or Firm*—Martin Fruitman

[57] ABSTRACT

A heater which uses the electrolysis of a liquid to produce heat from electricity and transfers the heat from the electrolyte by means of a heat exchanger. One embodiment includes electrodes of nickel and platinum and an electrolyte of potassium carbonate with a heat exchanger immersed in and transferring heat from the electrolyte.

12 Claims, 3 Drawing Sheets

ELECTROLYTIC HEATER

SUMMARY OF THE INVENTION

This invention deals generally with electrolysis and more specifically with a device which produces usable heat within an electrolytic cell.

While it is generally understood that heat generation is one of the results of electrolysis, the process of electrolysis has only been used for heat generation in a somewhat secondary manner. There have been some devices which generate hydrogen and oxygen by electrolysis and then combine them to create heat in a different locale, thus permitting the movement of the gases to substitute for heat transfer.

However, the present invention uses electrolysis to generate heat directly, and uses heat exchangers to transfer the heat generated from one or more electrolytic cells to other locations or heat transfer mediums where it is used conventionally. One of the advantages of such a system is that the generation of heat can take place at lower temperatures than are customarily used in electrical resistance or combustion heating systems, thereby reducing the likelihood of the combustion of surrounding materials and enhancing fire safety. However, the temperature can also be raised by permitting the cell to operate at a higher internal pressure, so that the electrolytic cell heat generator has a greater versatility than most heaters.

Another advantage is the direct generation of heat within a liquid. This permits the very efficient transfer of heat from one liquid, the electrolyte, to another liquid, such as water, without an intermediate step of heating gases as occurs in the typical combustion process.

The preferred embodiment of the present invention includes an electrolytic cell constructed of materials which yield a very high efficiency of heat generation within the electrolytic cell. A heat exchanger is immersed directly within the electrolyte, and the heat exchanger and can be used directly circulated through the heat exchanger and can be used directly as a source of hot water or can be pumped to a conventional finned heat exchanger to heat a remote location.

The electrolytic cell of the preferred embodiment has a nickel cathode, an anode constructed of platinum coated titanium, and an electrolyte of potassium carbonate. Recent studies indicate that this combination of materials produces heat within the cell with extremely high efficiency, so that all the electrical power input into the cell is converted to usable heat.

A preferred embodiment of the electrolytic heating apparatus includes an insulated polyethylene tank containing potassium carbonate electrolyte with wire or rod electrodes penetrating a removable cover of the tank, and large portions of the electrodes immersed in the potassium carbonate. Approximately one-half of the electrodes are nickel and are used as the cathodes of the cell, while the remainder of the rods are platinum coated titanium and are connected to act as the anodes.

Electrical connections to the electrodes are made on the outside of the tank, and the direct current voltage applied is approximately five volts. This low voltage is another factor in enhancing safety, since authorities consider it well below any level of danger from electrical shock. Of course, since power must be furnished by means of high current, heavy conductors are used to connect to the electrodes.

With heat being generated directly at the interface between the electrolyte and electrodes, it is only necessary to transfer heat from the electrolyte, and, as is well understood by those skilled in the art of heat transfer, liquid to liquid heat transfer is much easier to accomplish than gas to liquid heat transfer.

Therefore, in the preferred embodiment, a heat exchanger is constructed within the electrolyte tank by forming a coil of pipes around the group of electrodes. To prevent corrosion of the pipes by the electrolyte, the pipes of the preferred embodiment are constructed of polyethylene, or at least coated with a material which prevents the corrosive effects. A heat exchange fluid is then pumped through the coiled pipes to transfer heat from the electrolyte to any other location. A preferred heat exchange fluid is water, which can not only be used in all conventional pipes, but the hot water produced within the electrolytic cell can be used directly for household or industrial purposes. It should also be understood that multiple cells can be arranged in a group to increase the heat available.

The electrolytic cell also includes a conventional hydrogen recombiner to prevent hydrogen gas build up, and since this hydrogen combiner also generates some heat, the water it produces is drained back into the electrolyte to conserve that heat within the cell.

One alternate embodiment for the removal of heat from the electrolytic cell is a heat exchanger on the outside of the tank which requires no special accommodation to prevent corrosion by the electrolyte. In such an arrangement, the tank of the electrolytic cell isolates the pipes of the heat exchanger from the electrolyte, but the walls of the tank can be constructed of materials and thicknesses which still permit efficient heat transfer through them to the heat exchanger fluid in the pipes.

Still another method of utilizing the heat of the electrolytic cell is to pump the electrolyte to a remote location where it can be passed directly through a heat exchanger.

The present invention therefore furnishes a very efficient and safe heating system, and as with most electrically powered heaters, it can be installed in large sizes as a central heating unit or can be used as a localized heat source in smaller sizes. It is, however, particularly well suited as a water heater or furnace.

DETAILED DESCRIPTION OF THE INVENTION

Figure 1:
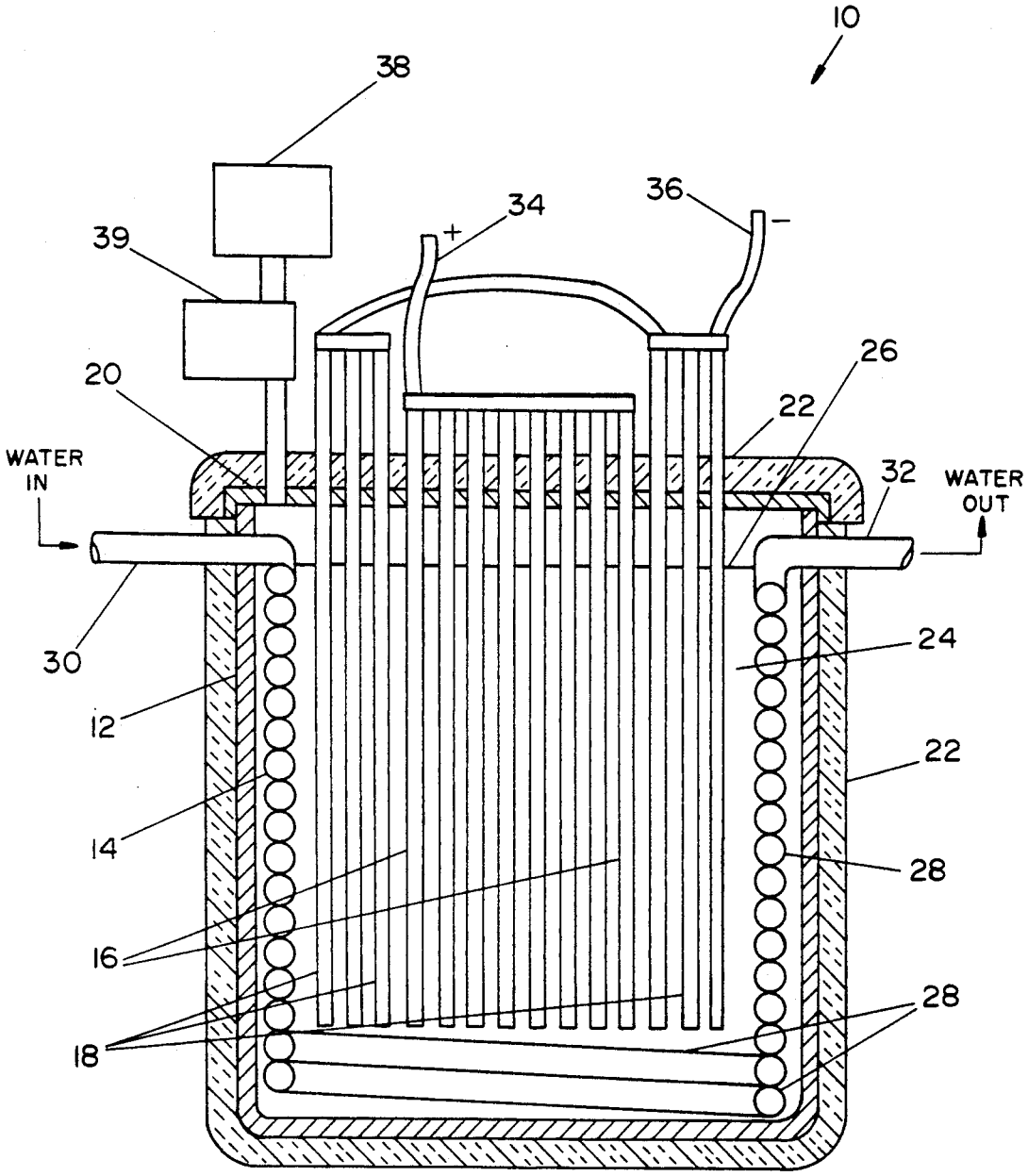
FIG. 1 is a partial cross section view of the electrolytic cell of the preferred embodiment of the invention as it is used to heat water.

FIG. 1 is a partial cross section view of the preferred embodiment of the invention in which electrolytic cell 10 is shown with pressure sealed tank 12 in a partial sectional view so that the internal assembly of heat exchanger 14, anodes 16 and cathodes 18 may be seen clearly.

Tank 12 is constructed of a corrosion resistant material such as polyethylene, or is at least coated with such a material on its inside surfaces, and is pressure sealed by cover 20 through which anodes 16 and cathodes 18 penetrate. Both tank 12 and cover 20 are covered by heat insulating material 22 to prevent incidental heat loss from electrolytic cell 10. Tank 12 contains liquid electrolyte 24 to approximately level 26, so that electrolyte 24 covers most of heat exchanger 14, anodes 16 and cathodes 18.

Heat exchanger 14 is constructed as a continuous coil of pipes 28 through which a liquid heat exchanger fluid, preferably water, is pumped by an outside device such as a pump (not shown). Liquid is fed into heat exchanger 14 at pipe 30 and leaves heat exchanger 14 at pipe 32 after having moved though the entire heat exchanger. Heat transfer takes place within tank 12 directly from electrolyte 24 to the liquid flowing in heat exchanger 14 through only the thin walls of heat exchanger pipes 28. This heat is originally generated by the electrolytic action caused by a direct current voltage applied across anodes 16 and cathodes 18 when they are immersed in electrolyte 24. The electrical connections are made at positive connection 34 and negative connection 36.

Heat generation by electrolytic action is particularly efficient when the combination of certain materials is used. One such combination, which is used in the preferred embodiment, is an electrolyte of potassium carbonate, anodes of platinum coated titanium and cathodes of nickel.

One desirable configuration for the cathodes 18 is a polished wire or rod constructed by sintering 300 mesh nickel powder with smooth particles. This structure provides a large surface area with small nucleation site radii for generation of hydrogen gas. Heat generation essentially takes place at the location where hydrogen gas is created, and heat generation is enhanced by the polished surface.

The positive voltage is applied to the anode from a conventional source (not shown) and, for the materials of the preferred embodiment, is approximately five volts.

FIG. 1 also depicts a typical location for hydrogen recombiner 38 and pressure regulator 39 connected at the top of tank 12. Hydrogen recombiner 38 is a conventional device which recombines the hydrogen and oxygen which are the result of the electrolytic process, and the resulting water returns any heat generated during the recombination process to the electrolyte from which the heat will be transported along with the rest of the heat generated.

Pressure regulator 39 is the means by which the maximum temperature of operation of electrolytic cell is controlled. With an open tank and without pressure regulator 39 the electrolyte would boil at a particular temperature determined by its chemical constituents and the atmospheric pressure, and no further increase in temperature would occur. Pressure sealed tank 12 and pressure regulator 39 permit the pressure within the cell to rise, the pressure rise being driven by the generation of gases from the electrolytic process, and as the pressure rises, the boiling temperature of the electrolyte also rises. Pressure regulator 39 can be adjusted to relieve the built up pressure at any preset value and will thereby control the maximum temperature of cell operation.

Figure 2:
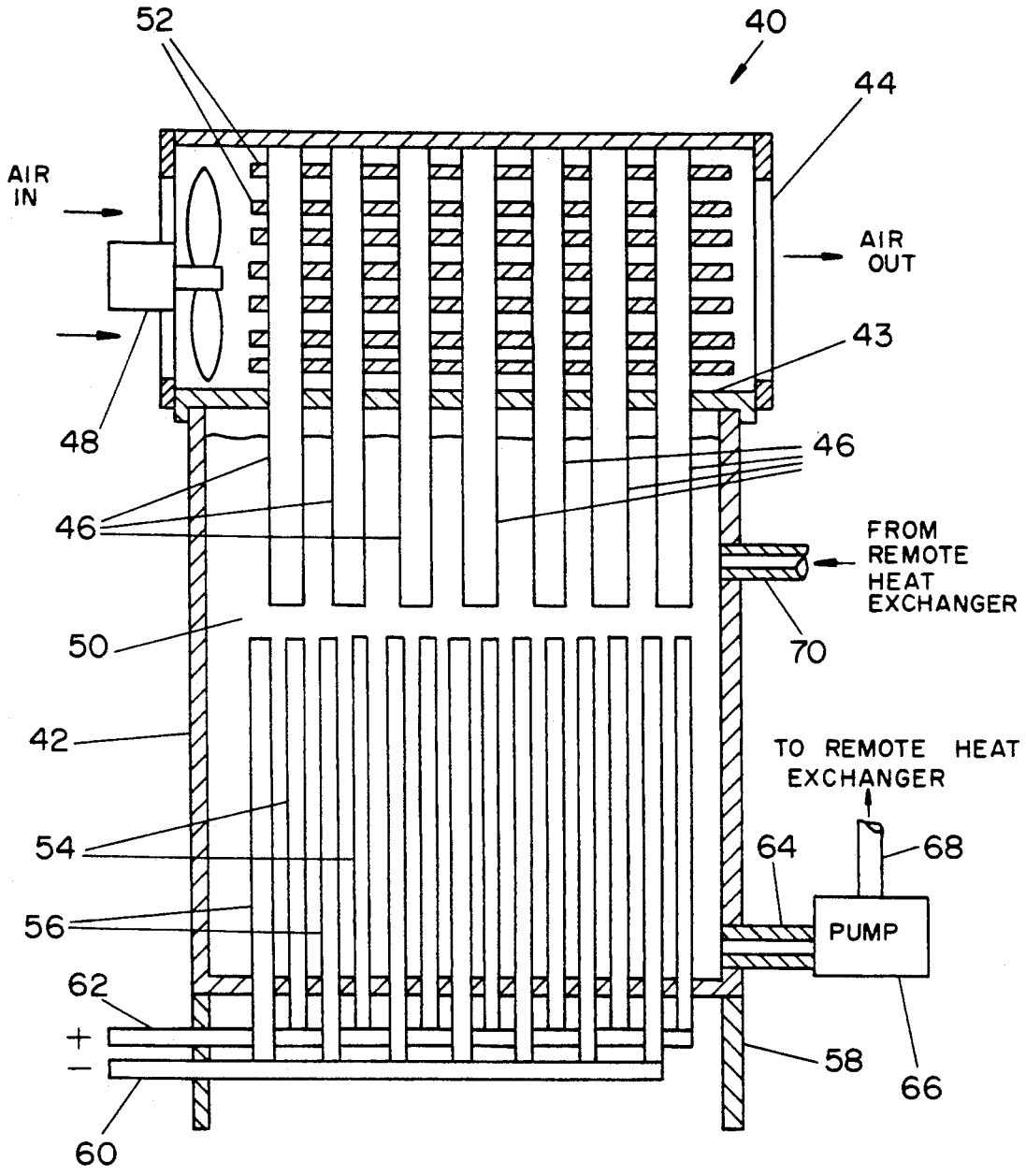
FIG. 2 is a partial cross section view of an alternate embodiment of the invention as it is used to warm air.

FIG. 2 is a partial cross section view of electrolytic cell 40 in which tank 42 is shown in partial cross section so that the internal structure of the cell may be seen. Normally tank 42 and cover 43 would be covered by heat insulation, but that has been omitted for clarity. It should also be appreciated that while the preferred configuration for the tanks shown in all the figures may be cylindrical, virtually any shape liquid container is satisfactory.

Electrolytic cell 42 includes heat exchanger 44 which transfers heat from the electrolyte of cell 40 to heat pipes 46 and then to air being moved through heat exchanger 44 by fan 48. Heat pipes 46 are immersed in electrolyte 50 in tank 42 and move the heat from warmer electrolyte 50 to cooler cooling fins 52 by the well known process of evaporation and condensation within the heat pipes.

As in the electrolytic cell of FIG. 1, heat is generated within electrolytic cell 40 by the electrolytic action of a D.C. voltage applied between anodes 54 and cathodes 56, but by means of heat pipes 46 and heat exchanger 44 the heat is transferred to an air stream which can be used to heat a room or other enclosed space.

Regardless of whether the ultimate use of the invention is to heat a liquid, as shown in FIG. 1, or a gas, as shown in FIG. 2, a simple means to control the temperature at which the electrolytic cell will operate, below the maximum temperature determined by the pressure within the tank, is to interrupt the removal of heat from the cell by a thermostatic device. This can be done by stopping or reducing the flow of liquid through heat exchanger 14 of FIG. 1 or by simply stopping fan 48 in FIG. 2. In either case the result would be an increase in temperature in the electrolytic cell until the fluid flow is reestablished.

In the alternate embodiment of FIG. 2, tank 42 is elevated on support structure 58 so that electrical connections 60 and 62 can be connected to anodes 54 and cathodes 56 at the bottom of tank 42. This configuration permits the heat exchanger to be located on top of the tank, but it would be possible to reverse the locations of the electrical connections and the heat exchanger, or even to locate them both at the top of the tank.

The configuration of FIG. 2 is particularly advantageous for a portable room heater since the normal operating temperature of even the hottest part of the apparatus can be limited to be well below the combustion temperature of common household materials such as paper and cloth.

FIG. 2 also depicts another means for removing heat from cell 42 by simply pumping heated electrolyte 50 out of cell 42 through output pipe 64, pump 66 and distribution pipe 68 to a remote heat exchanger (not shown). The cooled electrolyte is then returned to cell 42 by return pipe 70 for reheating.

Figure 3:
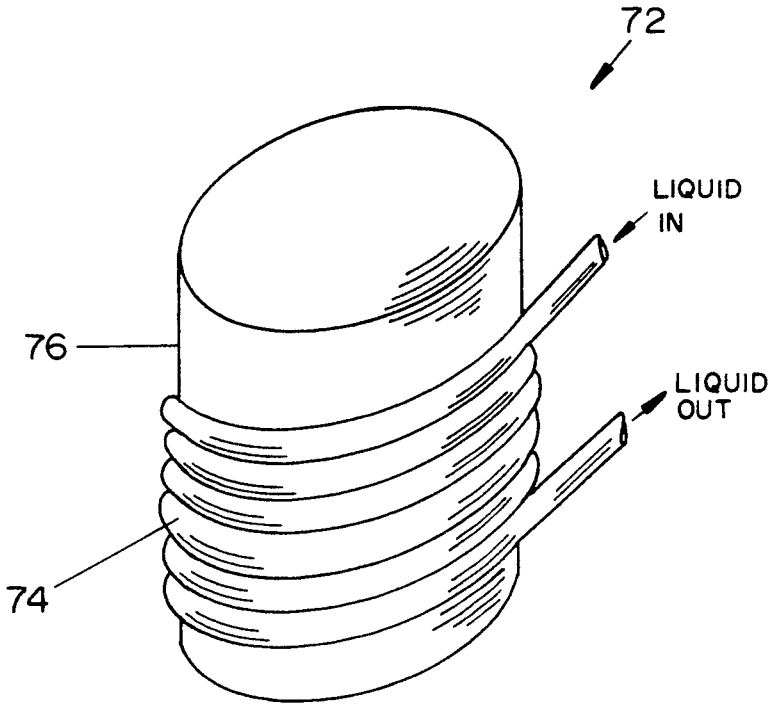
FIG. 3 is a perspective view of a simple liquid heat exchanger installed on the exterior surface of an electrolytic cell.

FIG. 3 depicts what is probably the simplest apparatus for transferring heat from an electrolytic cell. It involves simply wrapping a coiled heat exchanger pipe 72 around electrolytic cell 74 and insulating the entire structure. While this arrangement requires heat conduction through tank 76, proper selection of the material and thickness of tank 76 can provide for very effective heat transfer.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, other electrolytes, such as rubidium carbonate, can also be used, as can other materials for the electrodes.

What is claimed as new and for which Letters Patent of the United States are desired to be secured is:

1. A heat generating electrolyte cell comprising:
a tank constructed of corrosion resistant material, the tank being constructed to be able to contain a liquid electrolyte and including a sealed access cover which prevents the escape of gases from the tank;
at least one anode electrode within the tank and located so that it contacts electrolyte when contained within the tank;
an electrical connection attached to each anode electrode which supplies each anode electrode with a positive voltage;
at least one cathode electrode within the tank and located so that it contacts electrolyte when contained within the tank;
an electrical connection attached to each cathode electrode which supplies each cathode electrode with a negative voltage;
a heat transfer means located so that it is in thermal contact with liquid electrolyte when contained within the tank and functioning to transfer heat generated within the electrolytic cell to a location outside the cell; and
heat insulation covering the outside surfaces of the tank.

2. The electrolytic cell of claim 1 further including a hydrogen recombining means interconnected with the interior of the tank.

3. The electrolytic cell of claim 1 wherein the heat transfer means is a coil of pipes through which is pumped a liquid heat exchanger fluid, the coil of pipes being located within the tank so that it surrounds the anode and cathode electrodes within the tank.

4. The electrolytic cell of claim 1 wherein the heat transfer means is a pump which, when electrolyte is contained within the tank, moves the heated electrolyte to a remote location where heat may be removed from the electrolyte.

5. The electrolytic cell of claim 1 wherein the anode electrodes are constructed of platinum coated titanium.

6. The electrolytic cell of claim 1 wherein the cathode electrodes are constructed of nickel.

7. The electrolytic cell of claim 1 wherein the cathode electrodes are constructed of sintered nickel.

8. The electrolytic cell of claim 1 wherein the cathode electrodes are constructed of polished sintered nickel.

9. The electrolytic cell of claim 1 wherein the tank includes sealing means to permit pressurization of the tank.

10. The electrolytic cell of claim 1 wherein the tank includes sealing means to permit pressurization of the tank and a pressure regulator attached to the tank which permits raising the gas pressure within the tank to selected pressures above atmospheric pressure.

11. A heat generating electrolytic cell comprising:
a tank constructed of corrosion resistant material, the tank being constructed to be able to contain a liquid electrolyte and including a sealed access cover which prevents the escape of gases from the tank;
at least one anode electrode within the tank and located so that it contacts electrolyte when contained within the tank;
an electrical connection attached to each anode electrode which supplies each anode electrode with a positive voltage;
at least one cathode electrode within the tank and located so that it contacts electrolyte when contained within the tank;
an electrical connection attached to each cathode electrode which supplies each cathode electrode with a negative voltage; and
at least one heat pipe extending into a heat exchanger and located so that it is in thermal contact with liquid electrolyte when contained within the tank, the heat pipe functioning to transfer heat generated within the electrolytic cell to the heat exchanger.

12. A heat generating electrolytic cell comprising:
a tank constructed of corrosion resistant material, the tank being constructed to be able to contain a liquid electrolyte and including a sealed access cover which prevents the escape of gases from the tank;
at least one anode electrode within the tank and located so that it contacts electrolyte when contained within the tank;
an electrical connection attached to each anode electrode which supplies each anode electrode with a positive voltage;
at least one cathode electrode within the tank and located so that it contacts electrolyte when contained within the tank;
an electrical connection attached to each cathode electrode which supplies each cathode electrode with a negative voltage; and
a configuration of pipe external to the tank and in thermal contact with the tank through which is pumped a liquid heat exchanger fluid.

* * * * *